United States Patent [19]

Marsee

[11] 4,040,401

[45] Aug. 9, 1977

[54] SPARK VACUUM ADVANCE CONTROL

[75] Inventor: Frederick J. Marsee, Clawson, Mich.

[73] Assignee: Ethyl Corporation, Richmond, Va.

[21] Appl. No.: 521,035

[22] Filed: Nov. 5, 1974

[51] Int. Cl.[2] ..... F02P 5/04; F02M 25/06

[52] U.S. Cl. ..... 123/117 A; 123/119 A

[58] Field of Search ..... 123/117 A, 117 R, 146.5 A, 123/119 A

[56] References Cited

U.S. PATENT DOCUMENTS

| | | | |
|---|---|---|---|
| 3,234,929 | 2/1966 | Sarg | 123/146.5 A |
| 3,638,626 | 2/1972 | Marshall | 123/117 A |
| 3,727,596 | 4/1973 | Panhard | 123/117 A |
| 3,739,797 | 6/1973 | Caldwell | 123/119 A X |
| 3,780,713 | 12/1973 | Julian | 123/117 A |
| 3,807,374 | 4/1974 | Marsee | 123/119 A |
| 3,915,132 | 10/1975 | Thornburgh | 123/117 A |
| 3,948,232 | 4/1976 | Gould et al. | 123/117 A |

*Primary Examiner*—Carroll B. Dority, Jr.
*Assistant Examiner*—Tony M. Argenbright
*Attorney, Agent, or Firm*—Donald L. Johnson; Robert A. Linn; Willard G. Montgomery

[57] ABSTRACT

An ignition spark advance system for use with spark ignited internal combustion engines having an exhaust gas recycle system which includes EGR vacuum modulator means connected to and modulating an exhaust gas recycle valve. A conventional first vacuum actuated spark advance unit responsive to manifold vacuum signal cooperates with a second vacuum actuated spark advance unit responsive to EGR vacuum signal to advance the ignition spark. The second vacuum actuated spark advance unit provides additional spark advance during periods of lower intake manifold vacuum caused by exhaust gas recycle when the spark advance due to the first unit decreases.

14 Claims, 3 Drawing Figures

SPARK VACUUM ADVANCE CONTROL

BACKGROUND OF THE INVENTION

The subject matter of the present invention is a spark ignited internal combustion engine modification for improving control of the part throttle spark advance to provide improved fuel economy and driving performance when varying amounts of exhaust gas recycle are introduced into the intake system of the engine.

It is known that a reduction of nitrogen oxide ($NO_x$) content of exhaust gases can be achieved by recycling part of the exhaust gas from an internal combustion engine back into the intake system as part of the fuel-air charge. This is accomplished by providing a conduit from the exhaust system into the intake system of the engine and providing means for controlling the amount of exhaust gas which is fed into the intake system.

In conventional systems the vacuum advance used on a distributor increases the spark advance as manifold vacuum increases. In these systems, as the load increases, the intake manifold vacuum decreases and the spark advance decreases. Furthermore, when varying amounts of EGR (exhaust gas recycle) are added to the intake mixture the manifold vacuum is lowered accordingly. Thus, in a conventional distributor with a conventional spark advance system the spark advance decreases in response to the reduction in manifold vacuum caused by load increases, addition of EGR or both. However, it is under conditions of EGR introduction that the engine requires an additional ignition advance for optimum performance. Calibrating the distributor to a more advanced setting to compensate for the retarding effect of EGR introduction has the disadvantage of causing the ignition to be over-advanced during warmup or any condition where the EGR is off thereby resulting in knock and possible engine damage.

With the system of the present invention additional spark advance is provided during periods when EGR is used. Under conditions where the EGR is off no additional spark advance is provided and the distributor operates at the initial spark advance mode.

BRIEF SUMMARY OF THE INVENTION

A spark advance system for providing additional spark advance during periods when exhaust gas recycle system is in use which comprises a second vacuum actuated spark advance unit cooperating with a conventional first vacuum actuated spark advance unit in advancing the timing of the ignition spark advance system. The second vacuum actuated spark advance unit is operatively connected to and actuated by a vacuum signal from the exhaust gas recycle system.

DESCRIPTION OF THE PREFERRED EMBODIMENTS

The present invention provides a means of controlling the part throttle spark advance of spark ignited internal combustion engines to provide improved fuel economy and driving performance when varying amounts of exhaust gas recycle (EGR) are used. When a large amount of EGR is used to reduce the nitrogen oxide ($NO_x$) content of exhaust gases, the manifold vacuum is low. As the load is increased, resulting in lower manifold vacuum, additional recycle further lowers the manifold vacuum. Normally, this distorted condition makes it difficult to maintain a correct relationship between load and ignition timing. In the present invention, a second vacuum actuated spark advance unit is connected to either the original vacuum actuated spark advance unit or directly to the distributor. This second spark advance unit is responsive to and actuated by a vacuum signal from the EGR vacuum amplifier. The combination of the spark port signal, which is fed to the original spark advance unit, and the recycle signal, which is fed to the second spark advance unit, are combined to control the vacuum advance portion of the distributor.

A thorough understanding of the present system will be obtained by considering the various embodiments illustrated in the aforesaid drawings.

Figure 1:
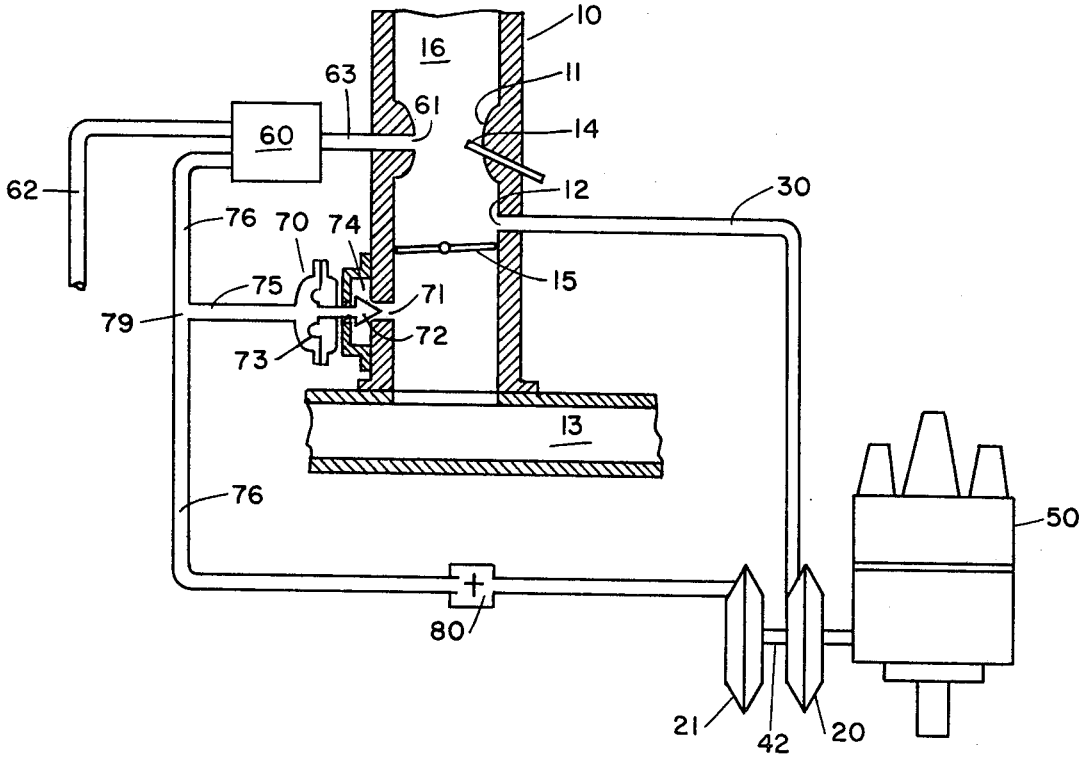
FIG. 1 is a schematic illustration in partial section of one embodiment of the spark advance system of the present invention. The drawing is not to scale.

Referring to FIG. 1, one embodiment of the spark advance system of the present invention is illustrated by way of example operating in combination with a carburetor 10 having a vacuum spark advance port 12 and a venturi section 11; an ignition distributor 50 having an ignition spark advance mechanism operated by first vacuum actuated spark advance unit 20; and a gas recycle system which includes EGR vacuum modulating means 60 connected to and modulating an exhaust gas recycle unit 70.

Carburetor 10 may comprise any conventional type which receives fresh air from the usual air filter (not shown) at the upstream end of barrel 16, through which the air-fuel mixture is conducted to the intake manifold 13, and comprises the usual main fuel metering system including the venturi restriction 11 and nozzle 14 for supplying fuel to the barrel 16 during various operating conditions. A carburetor vacuum spark advance port 12 opens into the carburetor barrel 16 just above the throttle plate 15. At idle or conditions of very low speed, throttle plate 15 is closed or nearly closed, consequently, carburetor vacuum spark advance port 12 is exposed to substantially atmospheric pressure. As the throttle plate 15 is revolved to open, in a counterclockwise direction, carburetor vacuum spark advance port 12 becomes exposed to the engine intake manifold vacuum.

Although in the preferred embodiment of the invention the carburetor vacuum spark advance port 12 opens into the mixing conduit 16 just above the throttle plate 15 this need not be the case in all situations. Thus, the carburetor vacuum spark advance port 12 can open into the barrel 16 substantially upstream of the throttle plate 15 or even downstream of the throttle plate. Therefore, it is to be understood that while in the preferred embodiment of the invention the carburetor vacuum spark advance port 12 opens into the barrel 16 just above the throttle plate 15, the present invention is operable with said spark advance port 12 opening into the barrel 16 in a location other than the position just above throttle plate 15. Optionally it can open directly into the intake manifold.

Ignition distributor 50 is of a conventional design well known in the art having an ignition spark advance mechanism of conventional design operated by first vacuum actuated spark advance unit 20. Extending between and operably connecting the carburetor vacuum spark advance port 12 and the first vacuum actuated spark advance means 20 is a vacuum line 30.

The exhaust gas recycle unit 70 is of a conventional design well known in the art. In the embodiment shown in FIG. 1 the exhaust gas recycle unit 70 is vacuum actuated and includes a diaphragm 73, a valve 72 connected to diaphragm 73 which controls the gas bleed into the barrel 16 through orifice 71 from chamber 74 into which is fed exhaust gas from the exhaust system and which acts as a reservoir for said exhaust gas. In the embodiment shown in FIG. 1 the orifice 71 is located in the barrel 16 of the carburetor 10 downstream of the throttle plate 15. However, the orifice can be positioned upstream of throttle plate 15 or even open directly into the intake manifold rather than into the carburetor. The exhaust gas recycle unit 70 is connected by conduit 75, T-connection 79, and conduit 76 to an exhaust gas recycle vacuum modulator 60. The exhaust gas recycle modulator is of a conventional design well known in the art and can be, for example, an EGR vacuum amplifier. In the preferred embodiment of the invention, as shown in FIG. 1, 60 is an EGR vacuum amplifier. The principle of operation of the EGR vacuum amplifier 60 is based on utilization of the venturi vacuum of the carburetor as a measure of total air flow. By amplifying the weak venturi signal for operation of the EGR valve, it is possible to maintain a degree of proportionality between the amount of EGR and total engine air flow. The amplifier 60 receives two inputs: (1) a weak venturi signal to be amplified, and (2) the relatively strong manifold vacuum signal for its source of power. The output signal has adequate strength to operate the EGR valve. An example of such an EGR vacuum amplifier is one produced by Ranco, Inc., 601 W. Fifth Ave., Columbus, Ohio, and described in an Information Bulletin entitled "EGR Vacuum Amplifier."

Referring now to FIG. 1, 60 represents the EGR vacuum amplifier. The vacuum amplifier is operatively connected to venturi vacuum port 61 from which the amplifier receives the weak venturi vacuum signal by vacuum line 63. A vacuum line 62 operably connects the vacuum amplifier 60 to the manifold 13 from which the amplifier 60 receives the relatively strong manifold vacuum signal.

Although in the preferred embodiment of the present invention as shown in FIG. 1, the exhaust gas recycle unit is operably connected to the EGR vacuum amplifier by conduits 75, T connection 79, and conduit 76, this need not be the situation in all cases. Thus, for example, the exhaust gas recycle unit can be connected directly to the EGR vacuum amplifier.

Figure 2:
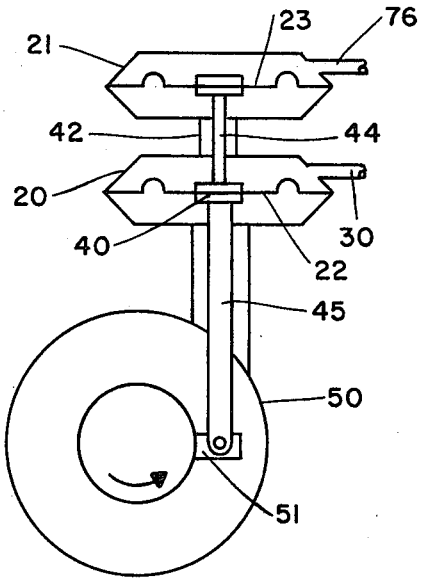
FIG. 2 is a plan view in section of the spark advance units of the present invention connected to the distributor in series. The drawing is not to scale.

A second vacuum actuated spark advance unit 21 is operably connected to the distributor 50 and cooperates with the first vacuum actuated spark advance unit 20 to advance the spark. The second vacuum actuated spark advance unit 21 is operatively connected at its other end to the source of EGR vacuum signal by conduit 76. A time delay switch 80 is positioned in conduit 76 upstream of the second vacuum actuated spark advance unit 21. In the embodiment as shown in FIG. 1, the second spark advance unit 21 is connected to the distributor 50 in series with the first spark advance unit 20. More specifically, the two spark advance units 20 and 21 are connected to the distributor 50 in-line. This need not be the case for all situations, however. Thus, for example, rather than being in line, as shown in FIG. 1 and FIG. 2, the two spark advance units 20 and 21 can be connected to the distributor 50 in series but not be in line with respect to each other. They may be connected to each other by means of a lever and pivot type arrangement.

In the in-series and in-line arrangement shown in FIG. 1 and FIG. 2 the two spark advance units 20, 21 which include diaphragms 22 and 23 respectively, are connected by rod 44 disposed within seal 42. Disposed within the distributor 50 is a movable breaker plate upon which are mounted the ignition breaker contact points, not shown. The breaker plate is rotatable in a plane at right angle to the axis of the distributor shaft to advance and retard the ignition spark. This movable breaker plate is revolved by operating arm referenced by the numeral 51 in FIG. 2. The operating arm 51 is attached to and moved by diaphragms 22 and 23 within the spark advance units 20 and 21 respectively through rods 44, 45 in a manner well known in the spark advance mechanism art. While in the embodiment shown in FIG. 2 two rods 44 and 45 connected to each other at 40 are used, it is also possible to use a single push rod integral to both spark advance units 20 and 21 rather than the two separate connected push rods each being integral to its respective spark advance unit.

Figure 3:
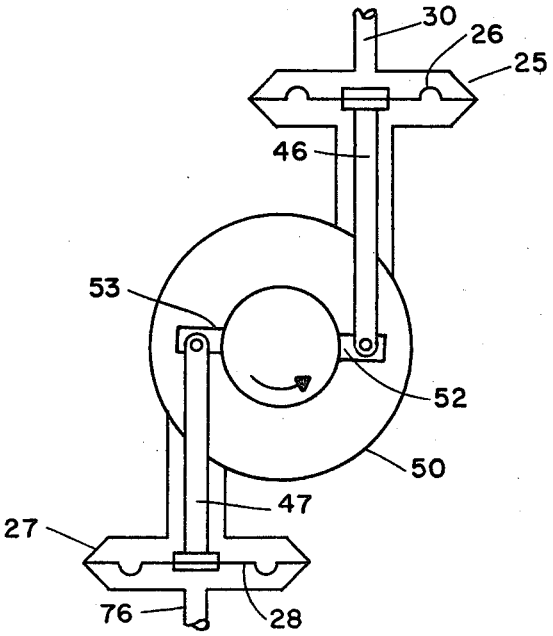
FIG. 3 is a plan view in section of the spark advance units of the present invention connected to the distributor in parallel. The drawing is not to scale.

Rather than being connected in series to the distributor 50, by which is meant for the purposes of this invention that arrangement wherein the separate vacuum actuated spark advance units are successivelly connected substantially end to end to form a single path for the rods, the spark advance units 25 and 27 can be operably connected to the distributor in parallel, by which is meant for the purposes of the present invention that arrangement wherein the separate vacuum actuated spark advance units are joined to the distributor forming several distinct paths for the rods 46, 47, as shown in FIG. 3.

In the embodiment shown in FIG. 3 the movable breaker plate of the distributor 50 has two operating arms 52, 53 by which it is revolved. Operating arm 52 is attached to and moved by diaphragm 26 within the first vacuum actuated spark advance unit 25 through rod 46 in a manner well known in the automotive art. Operating arm 53 is attached to and moved by diaphragm 28 within the second vacuum actuated spark advance unit 27 through rod 47 also in a manner well known in the automotive art.

The system of FIG. 1 operates as follows. During idle conditions or conditions of very low speed, throttle plate 15 is closed or nearly closed and, consequently, carburetor vacuum spark advance port 12 is exposed to substantially atmospheric conditions. Since there is no vacuum signal provided to the first vacuum actuated spark advance unit 20 through the vacuum line 30 there is no spark advance. With the carburetor throttle plate 15 rotated to open, in a counterclockwise direction, during acceleration or cruising speed, the carburetor vacuum spark advance port 12 is consequently exposed to engine intake manifold vacuum, the diaphragm 22 within the first or original vacuum actuated spark advance unit 20 is exposed to manifold vacuum signal on the side of vacuum line 30. Under these conditions, the diaphragm 22 within the first spark advance unit 20 and connected operating rod 45 are forced in a direction away from the distributor by the greater pressure in the side of the diaphragm opposite of the vacuum line 30 to rotate the movable breaker plate in the direction of the arrow to advance the ignition spark.

As the engine load increases the intake manifold vacuum drops and the spark advance correspondingly decreases. When the exhaust gas recycle system comes into operation, as during cruising speeds, and the exhaust gas is added to the intake mixture, the manifold vacuum is further lowered causing a decrease in spark advance. Even under conditions of low engine load, when there is no initial decrease in manifold vacuum and, therefore, correspondingly no decrease in spark advance, the introduction of the exhaust gas into the intake mixture through the EGR system results in a lowering of manifold vacuum which in turn causes a decrease in spark advance. It is at this point, when the EGR system comprising the EGR vacuum amplifier 60 and the exhaust gas recycle unit 70, comes into operation that the second spark advance unit 21 provides the additional ignition spark advance. To accomplish this second spark advance unit 21 and EGR unit 70 are matched so that the vacuum signal to each overcomes the diaphragm bias at about the same time. The second spark advance unit 21 is actuated by the vacuum signal which is put out by the EGR modulating means, which in the case of the embodiment shown in FIG. 1 is the EGR vacuum amplifier 60 and which is transmitted to the second spark advance unit 21 through conduit 76, which can be a vacuum line. As the signal from the EGR vacuum amplifier increases, the second spark advance unit 21 advances the ignition timing accordingly.

When there is no EGR vacuum amplifier signal provided to the second spark advance unit 21, i.e., when the venturi vacuum is not sufficient to trigger operation of the EGR vacuum amplifier 60, the diaphragm 23 within the second spark advance unit 21 is exposed to atmosphere on both sides. With sufficient venturi vacuum available, as for example at cruising speeds, to trigger operation of the EGR vacuum amplifier 60 and, therefore, the exhaust gas recycle unit 70, the diaphragm 23 within the second spark advance unit 21 is exposed to the EGR vacuum amplifier amplified venturi vacuum signal on the side of the conduit 76. Under these conditions, the diaphragm 23 within the second spark advance unit 21 and connected operating rod 44 are forced in the opposite direction, i.e., in a direction towards conduit 76 and away from the distributor 50, by the greater pressure on the side of the diaphragm opposite the conduit 76. This movement causes diaphragm 22 and connected operating rod 45 of the first spark advance means 20 to move in the same direction as diaphragm 23 and connecting rod 44 of the second spark advance means 21, thereby additionally rotating the movable breaker plate in the direction which will advance the ignition spark.

In the embodiment shown in FIG. 3, wherein the first spark advance means 25 and the second spark advance means 27 are connected to the distributor in parallel, the operation of the system of the present invention is substantially the same as described above. The difference lies in the action of the second spark advance unit 27 upon the distributor 50. Rather than acting through the first spark advance unit 25, the second spark advance unit 27 is connected directly to the distributor 50 and acts directly thereon. Thus, while connecting rod 46 of the first spark advance unit 25 is connected to operating arm 52 of the breaker plate, the connecting rod 47 of the second spark advance unit 27 is connected to a second operating arm 53 of the breaker plate. When a vacuum signal actuates the first spark advance unit 25 the diaphragm 26 and connected operating rod 46 are forced in the direction of the vacuum line 30 thereby rotating the movable breaker unit in the direction of the arrow to advance the ignition spark. Likewise, when a vacuum signal actuates the second spark advance unit 27 the diaphragm 28 and operating rod 47 are forced in the direction of the conduit 76 thereby additionally rotating the movable breaker point in the direction of the arrow to additionally advance the spark.

A vacuum delay valve 80 can be added to the system, as at conduit 76 upstream of the second spark advance unit 21. The vacuum delay switch 80 can be used when the spark advance units are connected either in series or in parallel. The vacuum delay valve 80 can be a one-way bleed valve of the type well known in the art. Basically, the vacuum delay valve functions to restrict the free bleed of the air from the side of the conduit 76 adjacent the second spark advance unit 21 into the low pressure area on the upstream side of the conduit 76 adjacent the EGR unit 70. This in effect delays the full vacuum signal from the EGR vacuum amplifier 60 from being transmitted to the second spark advance unit for a predetermined period of time. Thus the pressure drops in the downstream portion of conduit 76 located between the valve 80 and the second spark advance unit 21 is not immediately equal to the pressure drop in the conduit 76 upstream of the valve but is delayed for a period of time which can be predetermined by varying several factors, such as the size of the bleed hole or orifice in the one-way bleed valve. Therefore, by the use of this valve 80 a predetermined time period can be selected during which the pressure in the portion of the conduit 76 downstream of valve 80 gradually drops until it is equal to the pressure drop or vacuum conditions existent in the upstream portion of the conduit 76.

When the pressure in the upstream portion of conduit 76 is equal to and in equilibrium with the pressure in the downstream portion of the conduit 76, then both the EGR valve 72 and the second vacuum advance unit are receiving a vacuum signal of equal strength and are in approximately equal actuated conditions. However, due to the vacuum delay valve 80 the second vacuum advance unit 21 receives an EGR vacuum signal equal in strength to that received by the EGR unit 70 a predetermined period of time later than the EGR unit. That is, it takes a predetermined period of time for the pressure drop, or vacuum conditions, on the downstream side of the conduit 76 to gradually decrease to and equal the pressure drop, or vacuum conditions, existent on the upstream side of conduit 76. Thus vacuum delay valve serves as a time delay means to delay the full actuation of the second spark advance unit 21 by the EGR vacuum signal until after (e.g., 10–20 seconds) the vacuum signal from the vacuum amplifier is great enough to have actuated the EGR valve and then permits only gradual activation of the second spark advance means as vacuum bleeds through valve 80. In other words, vacuum delay valve 80 is adapted to delay the actuation of the second spark advance means for a predetermined time period after said exhaust gas recycle valve 72 opens or is actuated. Preferably valve 80 contains a one-way check valve which permits rapid release of vacuum from second vacuum advance means 21 when the vacuum amplifier vacuum signal drops.

Claims to the invention follow.

I claim:

1. In an ignition spark advance system for use with spark ignited internal combustion engines comprising in combination a. an ignition distributor having a spark advance mechanism operated by a first vacuum actuated spark advance means, b. a carburetor having a spark advance port, c. a vacuum line operably connecting said spark advance port with said first spark advance means, d. a vacuum actuated exhaust gas recycle valve, and e. an EGR vacuum amplifier having a vacuum line operatively connected to and adapted to modulate said exhaust gas recycle valve in response to operating conditions of said engine, the improvement comprising a second vacuum actuated spark advance means, said second spark advance means being operatively connected to said EGR vacuum amplifier by said vacuum line and actuated by a vacuum signal from said EGR vacuum amplifier, said first and said second spark advance means cooperating in advancing the timing of said ignition spark advance system when said exhaust gas recycle valve is open.

2. The system of claim 1 wherein said second spark advance means is actuated when said vacuum signal from said EGR vacuum amplifier increases to a vacuum sufficient to open said exhaust gas recycle valve.

3. The system of claim 2 wherein said first and said second spark advance means are first and second diaphragm means.

4. The system of claim 3 wherein said first and said second diaphragm means are operatively connected in series.

5. The system of claim 3 wherein said first and said second diaphragm means are operatively connected in parallel.

6. The system of claim 2 wherein said EGR vacuum amplifier has a vacuum output signal modulated in response to carburetor venturi vacuum.

7. The system of claim 6 wherein said first and said second diaphragm means are operatively connected in series.

8. The system of claim 6 wherein said first and said second diaphragm means are operatively connected in parallel.

9. The system of claim 2 further characterized by including a vacuum delay means in said vacuum signal to said second spark advance means adapted to delay the actuation of said second spark advance means for a predetermined time period after said exhaust gas recycle valve opens.

10. The system of claim 6 further characterized by including a vacuum delay means in said vacuum signal to said second spark advance means adapted to delay the actuation of said second spark advance means for a predetermined time period after said exhaust gas recycle valve opens.

11. The system of claim 4 wherein said first and said second diaphragm means are operatively connected to each other in series.

12. The system of claim 4 wherein said first and said second diaphragm means are operatively connected to said ignition distributor spark advance means in series.

13. The system of claim 5 wherein said first and said second diaphragm means are operatively connected to each other in parallel.

14. The system of claim 5 wherein said first and siad second diaphragm means are operatively connected to said ignition distributor spark advance means in parallel.

* * * * *